US005652032A

United States Patent [19]

Kaczor et al.

[11] Patent Number: 5,652,032

[45] Date of Patent: Jul. 29, 1997

[54] ARTIFICIAL CHRISTMAS TREE

[76] Inventors: Sheila Kaczor, 14886 Shenandoah Bldg 10; Michael Keleman, 14886 Shenandoah, both of Riverview, Mich. 48192

[21] Appl. No.: 602,121

[22] Filed: Feb. 15, 1996

[51] Int. Cl.[6] ..... A47G 33/06

[52] U.S. Cl. ..... 428/18; 211/196; 211/205; 428/20

[58] Field of Search ..... 428/18, 20; D11/118; 211/196, 205; 362/123

[56] References Cited

U.S. PATENT DOCUMENTS

| | | | |
|---|---|---|---|
| 984,591 | 2/1911 | Nelson | 211/196 |
| 2,672,277 | 11/1954 | Strasser | D11/118 X |
| 3,003,623 | 10/1961 | Paul et al. | 428/18 X |
| 3,011,280 | 12/1961 | Keidd | 428/18 X |
| 3,532,874 | 10/1970 | Rosenast | 362/123 X |
| 3,928,689 | 12/1975 | Mottel | 428/9 |
| 3,985,924 | 10/1976 | Pritza | 428/9 |
| 4,054,696 | 10/1977 | Crownover | 428/9 |
| 4,468,421 | 8/1984 | Wang | 211/205 X |

*Primary Examiner*—Henry F. Epstein
*Attorney, Agent, or Firm*—Gifford, Krass, Groh, Sprinkle, Patmore, Anderson & Citkowski, P.C.

[57] ABSTRACT

The invention relates to a hassle-free artificial Christmas tree that eliminates the time and frustration of assembly and storage of previously known artificial Christmas trees. The artificial Christmas tree of the present invention is preferably formed of a central pole having a sleeve concentric with the central pole and slidable along the central pole between an upper and lower position. At least one arm is rotatably coupled to the central pole and forms a limb of the tree. The sleeve is provided with an opening, including a flange framing the opening, for urging the arm between an upper and lower position when the sleeve is slid along the central pole. A base is provided for supporting the central pole in an upright position. A storage tube is also provided for storing the artificial tree when not in use. The storage tube has an opening for receipt and retrieval of the tree. The tree is readily slidable within the storage tube and is closed on either end by end caps. One of the end caps provided also acts as the base for supporting the central pole in the upright position when the tree is in use.

16 Claims, 1 Drawing Sheet

ARTIFICIAL CHRISTMAS TREE

BACKGROUND OF THE INVENTION

I. Field of the Invention

The present invention relates generally to an artificial Christmas tree. More particularly, the present invention relates to an artificial Christmas tree that is readily assembled and provides a long lasting storage facility.

II. Description of the Relevant Art

Generally, artificial Christmas trees consists of a central pole and individual limbs to be placed within and about the pole. The tree may be furnished with a base for supporting the central pole in an upright position.

The disadvantage of these previously known artificial Christmas trees is the time consumption in assembling the tree. Each branch provided for the tree is generally of a different length and time must be taken to determine the proper placement of the branch along the central pole to create the natural profile of a tree.

A still further disadvantage of these previously known artificial Christmas trees is that storage is not normally provided. The consumer is required to keep the box that the tree was purchased in for later storage. Usually the box is formed of cardboard and has a tendency to break down over the years or may get wet and fall apart from continuous storage in the basement.

Finally, a still further disadvantage of the previously known artificial Christmas trees is the time it takes to take down the tree, including removal of every branch and placement of the branch within the cardboard box for storage.

SUMMARY OF THE INVENTION

The invention relates to a hassle free artificial Christmas tree that eliminates the time and frustration of assembly and storage of the previously known artificial Christmas trees.

The artificial Christmas tree of the present invention is preferably provided in a single storage tube made of resilient material, such as plastic. The tube extends the length of the tree and is provided with an opening on either end of the tube. Each end of the tube is covered with a removable cap. Preferably, upon removal of one cap, the cap doubles as a base for supporting the artificial Christmas tree stored inside the tube.

The artificial Christmas tree of the present invention is stored in the tube in a lowered, or closed position. A cap is removed from the tube end and the tree is slid out from the tube. The tree is locked in the closed position with a locking mechanism provided along a central pole.

The artificial Christmas tree of the present invention preferably comprises an elongate central pole whose length essentially determines the height of the tree. A sleeve, concentric with the central pole, is slidable along the central pole between an upper, or open position, and a lower, or closed position. The locking assembly provided on the central pole locks the sleeve in the upper or lowered position. Arms are rotatably coupled to this central pole and form individual limbs of the tree. An opening is provided in the sleeve for each arm extending from the central pole through the sleeve. Each opening in the sleeve includes a flange framing the opening for rotating the arm from a closed, or lower position to an open, or upper position upon assembly of the tree.

A tree top is provided separate of the artificial tree assembly and comprises a central rod that readily fits within the inner diameter of the sleeve when the tree is in the open position.

A base is provided for supporting the tree in an upright position. The base is formed from one end cap of the storage tube. The base has a central hole for supporting the outer diameter of the central pole. The base also includes a support leg that may be rotated down to aid in supporting the tree in an upright position. A spring, seated on the upper end of the central pole biases the tree in an open, or upper position. The concentric sleeve, open at both ends, is provided with angled flanges along the topmost end. These flanges angle inward from the upper most portion of the sleeve toward the central pole. The flanges along with the support base provided on the central pole place tension on the spring when the tree is in the lower, locked position.

Upon removal of the tree from the storage tube, the user releases the lock thereby allowing the sleeve to travel from the lower position to an upper position along the central pole. The sleeve will immediately travel to the upper position due to the relief of tension in the spring when the sleeve is unlocked from the lower position along the central pole. As the sleeve travels from a lower, closed position to an upper, open position, the artificial limbs of the tree are forced to rotate from a closed position to an open position. That is, the flange provided along the opening of the sleeve corresponding to each limb pushes the limb in an upper, open position. The user then pushes the sleeve into the fully opened position and locks the sleeve in place along the central pole.

The base, including the support legs are prepared for placement of the central pole within the base. The base supports the pole in an upright position. The user then places the tree top within the sleeve at the opposite end of the base. The artificial tree is completely assembled and ready for decoration.

The artificial tree may also be provided with preset lighting, Christmas tree ornaments, flocking, and tinsel as required. The tree, with storage tube, may readily be provided in any length according to the preference of the purchaser.

An advantage of this artificial Christmas tree is that of convenience and storage of the tree.

A still further advantage is the ease of assembly and, once assembled, the limited space needed for presentation of the artificial tree.

A still further advantage is the durability of the tree. A still further advantage is that the tree may be formed of recycled material such as plastic, thereby making the tree environmentally friendly.

Other advantages and features of the present invention will become more apparent from the following detailed description when read in conjunction with the accompanying drawing.

BRIEF DESCRIPTION OF THE DRAWINGS

The present invention will be more fully understood by reference to the following detailed description of the preferred embodiments of the present invention when read in conjunction with the accompanying drawing, in which like reference characters refer to like parts throughout the view, and in which.

DETAILED DESCRIPTION OF THE PREFERRED EMBODIMENT OF THE PRESENT INVENTION

Figure 1:
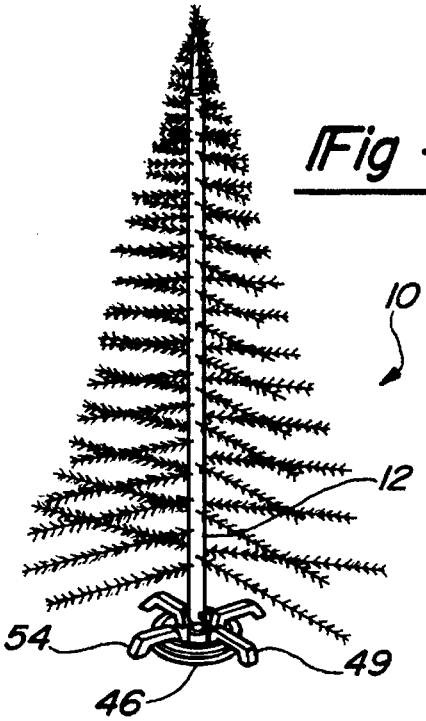
FIG. 1 is a plan view of an artificial Christmas tree in fully opened, or upper position.
Figure 2:
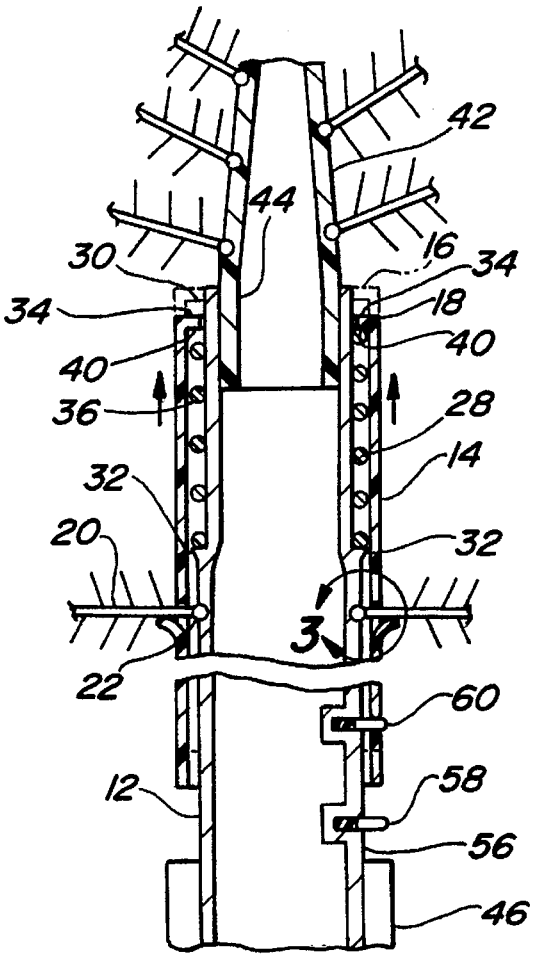
FIG. 2 is an enlarged view of the limb coupling assembly of the embodiment shown in FIG. 1.

With reference to FIGS. 1 and 2, the artificial Christmas tree of the present invention is thereshown in a fully assembled, open position 10. The artificial Christmas tree 10 includes a central pole 12 whose length is determinative of the height of the Christmas tree. A sleeve 14, concentric with the central pole 12 is slidable along the central pole 12 between an upper position 16 and a lower position 18. At least one arm 20 is preferably provided to form a limb of the tree 10. Arm 20 is rotatably coupled to the central pole 12 for rotation from the lower, closed position 18 to an upper, open position 16. Arm 20 is coupled to the central pole generally at 22.

Figure 3:
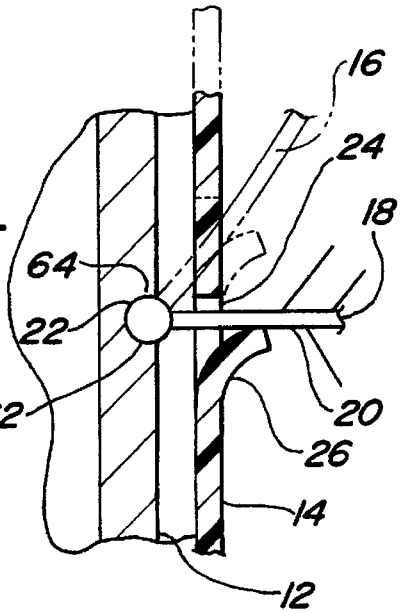
FIG. 3 is a sectional view taken along line 3—3 of FIG. 2.

With reference to FIG. 3, an opening 24 is provided in the sleeve 14 to accommodate rotation of arm 20 along the central pole 12. A flange 26 is also provided along the opening 24 to urge the arm 20 from the lower, closed position 18 to the upper, open position 16. Flange 26 also provides a force to rotate arm 20 downward when the user is disassembling the tree and moving the sleeve from the upper, open position 16 to the lower, closed position 18.

Figure 4:
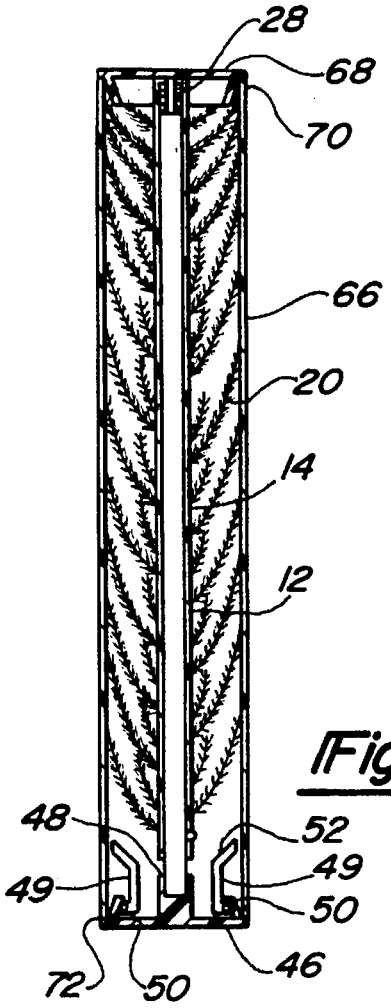
FIG. 4 is a plan view showing the artificial Christmas tree in a fully closed, or lowered position and stored in the storage unit.

With reference to FIGS. 2 and 4, a biasing element 28, preferably a spring, is provided at the upper end 30 of the central pole 12. A seat 32 is provided along the central pole 12 to accommodate the spring 28.

Flange 34 is also provided within the upper end 36 of the sleeve 14 corresponding to the upper end 30 of central pole 12. Flange 34 extends from the outer diameter 38 inwardly toward central pole 12. The distance (d) between the inner edge 40 of the flange 34 and seat 32 is shorter than the overall length of spring 28 when sleeve 14 is in the lower, or closed position 18. Spring 28 is, therefore, biased, or tensioned, when the tree is in the overall closed position 18.

Tree top 42 is provided separate from the artificial tree assembly unit 10. Tree top 42 includes a central pole 44 for insertion into sleeve 14 at its upper end 36 when the sleeve is in the upper or open position 16.

With reference to FIGS. 1 and 4, a base 46 is provided with a central opening 48 for supporting the central pole 12 in an upright position. Base 46 includes at least one support leg 49 that is rotatable about pin 50 from a closed position 52 to accommodate storage, to an open position 54 to aid in supporting central pole 12 in an upright position.

With reference to FIG. 2, a duo locking mechanism is provided at the base 56 of central pole 12. Locking mechanism 58 is located in line and below locking mechanism 60. Locking mechanism 58 locks the sleeve in a lower, closed position 18. Releasing locking mechanism 58 subsequently releases the tension in spring 28. Sleeve 14 then slides upward along central pole 12. Correspondingly, arm 20 rotates in opening 24. The user must move sleeve 14 into the completely open, upper position 16 and lock the sleeve in place using locking mechanism 60. Tree 10 is then in the fully opened, upper position 16. Tree top 42 may then be inserted into the upper end 36 of sleeve 14. The tree 10 is now completely assembled and ready for decorating.

With reference to FIG. 3, an enlarged view is provided to show the coupling 22 of arm 20 to central pole 12. Preferably, arm 20 is provided with a ball 62 at one end of the arm 20. Ball 62 slip fits into corresponding socket 64. This ball and socket arrangement allows for easy rotation of the arm 20 between the lower position 18 and upper position 16 of the tree assembly 10.

With reference now to FIG. 4, a sectional view of the artificial Christmas tree in the fully closed position 18 within storage tube 66 is thereshown. Tree top 42 has been removed from the upper end 36 of sleeve 14. Locking mechanism 60 has been released and sleeve 14 is slid from the upper position 16 along central pole 12 to the lower position 18 and locked in this position by locking mechanism 58. Central pole 12 is removed from base 46.

The unassembled tree unit 10 is then slid into storage tube 66. End cap 68 is provided for closure of storage tube 66 at one end 70. Support leg 48 is rotated about pin 50 into closed position 52. Base 46 then acts as a second end cap to close the opposite end 72 of storage tube 66. FIG. 4 shows the artificial Christmas tree of the present invention in a completed stored state. Reassembly of the artificial Christmas tree of the present invention is performed by removing base 46 from end 72 and sliding the disassembled unit 10 out from end 72. Sleeve 14 is then released from lower locking mechanism 58 and spring biased into the upper position 16. Locking mechanism 60 ensures that the assembled tree 10 will then stay in upper position 16 during use.

The artificial Christmas tree of the present invention may be provided with preset lights or ornaments. Arms 20 may also be provided with flocking or any other decorations that may be preferred by the user.

Having described our invention, however, many modifications will become apparent to those skilled in the art. These and other changes are within the spirit of the invention as defined by the scope of the appended claims.

We claim:

1. An artificial Christmas tree comprising:

a central pole;

a sleeve concentric with said central pole and slidable along said central pole between an upper and lower position; and an arm rotatably coupled to said central pole and forming a limb of said tree;

said sleeve further comprising means for rotating said arm between an upper and lower position comprising an opening in said sleeve including a flange flaming said opening for urging said arm between said upper and lower position when said sleeve is slid along said central pole.

2. The tree as defined in claim 1 and further comprising means for biasing said sleeve in said upper position.

3. The tree as defined in claim 1 and further comprising means for locking said sleeve in said upper and lower positions.

4. The tree as defined in claim 3 and further comprising a base for supporting said central pole in an upright position.

5. The tree as defined in claim 4 and further comprising means for storing said tree when said sleeve is in said lower, locked position.

6. The tree as defined in claimed 5 wherein said means for storing said tree when said sleeve is in said lower, locked position comprises an elongated tube having an opening for receipt and retrieval of said tree.

7. The tree as defined in claim 6, said elongated tube further comprising a cap for enclosing said opening of said tube.

8. The tree as defined in claim 7, wherein said cap forms said base, said base having a retractable arm for supporting said central pole in said upright position.

9. The tree as defined in claim 1 and further comprising an arm removably mounted on one end of said sleeve and forming the top of said tree.

10. An artificial Christmas tree comprising:

a central pole;

a sleeve concentric with said central pole and slidable along said central pole between an upper and lower position; and means for storing said tree when said sleeve is in said lower position comprising an elongated tube having an opening for receipt and retrieval of said tree, a cap for enclosing said opening of said tube, wherein said cap forms a base for supporting said central pole in an upright position.

11. The tree as defined in claim 10 and further comprising an arm rotatably coupled to said central pole and forming a limb of said tree.

12. The tree as defined in claim 11, said sleeve further comprising means for rotating said arm between an upper and lower position, said rotating means comprising an opening in said sleeve including a flange framing said opening for urging said arm between said upper and lower position when said sleeve is slid along said central pole.

13. The tree as defined in claim 10 and further comprising means for biasing said sleeve in said upper position.

14. The tree as defined in claim 10 and further comprising means for locking said sleeve in said upper and lower positions.

15. The tree as defined in claim 10 and further comprising an arm removably mounted on one end of said sleeve and forming the top of said tree.

16. An artificial Christmas tree comprising:

a straight central pole;

a straight sleeve concentric with said central pole and slidable along said central pole between an upper and lower position;

an arm rotatably coupled to said central pole and forming a limb of said tree; and means for storing said tree when said sleeve is in said lower position, said sleeve further comprising means for rotating said arm between an upper and lower position.

* * * * *